US005281505A

United States Patent [19]

Inoue et al.

[11] Patent Number: 5,281,505

[45] Date of Patent: Jan. 25, 1994

[54] TONER COMPOSITION

[75] Inventors: Masahide Inoue, Nara; Tetsuya Nakano, Mie; Naruo Yabe, Hyogo; Teruaki Teratani, Osaka; Koichi Tsuyama, Hyogo; Yoshitake Shimizu; Seijirou Ishimaru, both of Osaka, all of Japan

[73] Assignee: Mita Industrial Co., Ltd., Osaka, Japan

[21] Appl. No.: 720,419

[22] Filed: Jun. 25, 1991

[30] Foreign Application Priority Data

Jun. 26, 1990 [JP] Japan ..... 2-167798
Jul. 20, 1990 [JP] Japan ..... 2-193212

[51] Int. Cl.[5] ..... G03G 9/00

[52] U.S. Cl. ..... 430/106; 430/105; 430/104

[58] Field of Search ..... 430/106, 105, 104

[56] References Cited

U.S. PATENT DOCUMENTS 5,104,766 4/1992 Nakano et al. ..... 430/110
5,110,704 5/1992 Inoue et al. ..... 430/110

FOREIGN PATENT DOCUMENTS 63-146047 6/1988 Japan .

OTHER PUBLICATIONS

Chemical Abstracts 109(22):201421f, Tomita et al., Electrostatographic toner containing agglomerated colorant particles, 1988.

*Primary Examiner*—Marion E. McCamish
*Assistant Examiner*—Mark A. Chapman
*Attorney, Agent, or Firm*—Cushman, Darby & Cushman

[57] ABSTRACT

A toner composition comprising a binder resin having dispersed therein additives including a colorant and a charge control agent, wherein said additives are present as agglomerates having an average sectional area of from 1.4 to 1.7 $\mu m^2$ in a section of toner particles, the total sectional area of the agglomerates in the section of toner particles ranging from 1.5 to 1.8%, or wherein said colorant and charge control agent are present as agglomerates having an average sectional area of from 1.4 to 1.7 $\mu m^2$ in a section of toner particles, and said composition has such rheological characteristics that a dissipation factor (tan $\delta$) is from 0.95 to 1.25 when a storage elastic modulus (G') is $10^4$ dyne/$cm^2$.

8 Claims, 1 Drawing Sheet

TONER COMPOSITION

BACKGROUND OF THE INVENTION

1. Field of Invention

This invention relates to a toner for use in electrophotography or electrostatic printing. More particularly, the invention provides a toner which overcomes various disadvantages of known toners, such as toner scatter, background fog, and contamination of a fixing roller, while maintaining a high image density and a toner which exhibits satisfactory developing properties, fixing properties and anti-offset properties as well as improved durability and improved image uniformity to provide a high quality image.

2. Description of Related Art

In electrophotography and electrostatic printing, a toner is used for development of an electrostatic latent image. A toner generally comprises ground particles of a prescribed size of a resin composition comprising a binder resin having incorporated therein a colorant, a charge control agent, etc.

Development of an electrostatic latent image is performed by a two-component system using a two-component developer composed of a toner and a magnetic carrier in which a photoreceptor having an electrostatic latent image thereon receives a stroke of a magnetic brush of the developer to form a toner image, or by a one-component system using a one-component developer solely comprising a toner in which a developing sleeve of a thin layer of charged toner particles is formed and the toner is adhered on a photoreceptor having a latent image thereon by flying or stroking under a development electric field to form a toner image on the photoreceptor. The thus formed toner image is then transferred from the photoreceptor surface to paper. The transferred toner image is usually fixed by contact with a fixing heat roller.

In either of the above-described developing systems, the toner must be charged to have a proper charge quantity and always maintain a constant charge quantity on repetition of image formation.

Charging of the toner is generally effected through frictional electrification, i.e., friction of a toner predominantly with a magnetic carrier in the case of the two-component developer or friction of a toner predominantly with a blade in the case of the one-component developer. In either case, friction among toner particles also serves as a great charging factor. Charging characteristics of toners depend to some extent on the binder resin used, but the charge quantity is not stable on repetition of image formation, easily getting too high or too low. This problem has been coped with by incorporating a charge control agent into the toner to stabilize the toner charge quantity. However, since a toner is very delicate in charging, if a resin composition has poor dispersion properties, charging properties greatly vary among individual toner particles even in the presence of a charge control agent. This being the case, toner particles of opposite polarity or toner particles of low charge are produced in an appreciable proportion, causing a scatter of a toner inside an image forming apparatus and background fog. Further, if the charge control agent is localized in the toner, the toner and the charge control agent are deposited and accumulated on a fixing roller, causing contamination of not only the fixing roller but also the transfer paper.

Moreover, the dispersion state of a colorant in the composition not only decides the coloring power but has great influence on charging characteristics of the toner. Poor dispersion of the colorant sometimes causes an abnormal increase in charge quantity or insufficient charging.

To meet demands for high image quality, developing conditions have become increasingly severe. Agglomeration of a toner as well as instability of charge quantity easily cause deterioration of image quality. The dispersion state of additives such as the charge control agent and the colorant influences agglomeration of a toner, sometimes causing apparent fog or white spots (where a toner is lacking in an image area).

In the field of commercial electrophotographic copy, there are applied systems which comprise forming an electrostatic image on a photoreceptor, developing this electrostatic latent image with charged toners, transferring the formed image of the toner onto a paper and the like, heat-fixing the transferred image.

The fixing of a toner image transferred to transfer paper is generally carried out by a thermal fixing process, preferably using a heat roller for greater ease and safety of operation. However, such thermal fixing can cause the off setting of a toner to the roller. Various means for preventing offset have hitherto been proposed. For example, an offset preventing liquid is applied to the fixing roller, or a parting agent is incorporated with the toner.

Another way which has been proposed to prevent offset is by controlling the molecular weight or viscoelasticity (rheological characteristics) of a binder resin of the toner. For example, JP-A-59-214960 (the term "JP-A" as used herein means an "unexamined published Japanese patent application") proposes to use a thermoplastic resin having a complex elastic modulus whose real part (storage of elastic modulus) ranges from $5\times10^4$ to $5\times10^5$ Pa and whose imaginary part (loss of elastic modulus) ranges from $5\times10^4$ to $2\times10^6$ Pa as a binder resin.

Although the '960 proposals are of interest for their effect on storage and loss of elastic modulus in a binder resin, no strict correlation was established between these rheological characteristics and the actual fixing and anti-offset properties. While the proposals are concerned with the binder resin to be used, in actual use the toner still shows a scattering in the range of fixing temperature, the occurrence of offset, depending on the dispersion state of a colorant or a charge control agent, even with a binder resin conforming to the standards of the '960 proposals. Thus, satisfactory results have not yet been obtained.

Even though a toner image may be fixed on transfer paper without the occurrence of offset, cases still occur not infrequently in which unevenness of the surface of the fixed image impairs uniformity of the image area. This results in a local difference in density or gloss, which further results in a nonuniform or unclear appearance. Besides deteriorating the image quality, the unevenness of the fixed image surface causes toner particles to fall off the image area when the copy contacts other objects, such as hands, paper, and desks. Thus hands, clothing, and other sheeting become stained as well as the copy itself .

Further, toner particles having poor impact resistance are apt to become pulverized or release dispersed, thus acting as substances which produce defective particles when the toner is agitated in a developing machine.

Production of such defective particles leads to production of spent toner on the carrier or charge-imparting element (e.g., a blade or a sleeve). It can also lead to variation in the charging tendency of a developer, thereby greatly changing the charge quantity of the toner.

SUMMARY OF THE INVENTION

An object of the present invention is to provide a high quality toner which provides a high density image in a stable manner without causing the scatter of toner, background fog or the contamination of a fixing roller.

Another object of the present invention is to provide a high quality toner which is prevented from agglomerating and therefore causes no fog or white spots on an image.

A further object of the present invention is to provide a high quality toner which adequately balances between sufficient adhesion of the toner in a fused state to transfer paper and avoiding offset onto a fixing roller. Such a toner also provides a transferred and fixed image having a smooth surface and thus having no local density difference.

A still further object of the present invention is to provide a high quality toner which provides a toner image with toner particles that do not fall off and stain other objects.

In a first embodiment of the present invention, there is provided a toner which is a composition comprising a binder resin having dispersed therein additives including a colorant and a charge control agent. These additives are present as agglomerates having an average sectional area of from 1.4 to 1.7 $\mu m^2$ in a section of toner particles, with the total sectional area of the agglomerates in the section of toner particles ranging from 1.5 to 1.8%.

In a second embodiment of the present invention, there is provided a toner which is a composition comprising a binder resin having dispersed therein a colorant and a charge control agent. This colorant and charge control agent are present as agglomerates having an average sectional area of from 1.4 to 1.7 $\mu m^2$ in a section of toner particles. Further, the composition has such rheological characteristics that a dissipation factor (tan $\delta$) is from 0.95 to 1.25 when a storage elastic modulus (G') is $10^4$ dyne/cm$^2$.

In the second embodiment, it is preferable that the total sectional area of the agglomerates ranges from 1.5 to 1.8% of the section of toner particles.

In the first and second embodiments, it is preferable that the charge control agent is a metal complex dye.

DETAILED DESCRIPTION OF THE PREFERRED EMBODIMENTS

Figure 1:
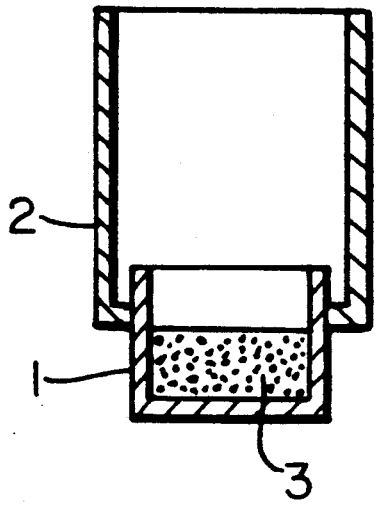
FIG. 1 is a cross section of a cell to be used for measurements of degree of compaction.

The first embodiment of the present invention is explained below.

The inventors have conducted extensive studies on a binder resin and additives such as a colorant and a charge control agent. As a result, they have found that, by controlling the size of the agglomerates of the additives in a resin composition and controlling the area ratio of the agglomerates in the resinous phase, the formation of toner particles of opposite polarity or of low charge can be suppressed so that variations in the charge quantity of the toner on repetition of image formation can be confined within a proper range and, in addition, disadvantages associated with thermal image fixing can be eliminated.

Agglomerates in the composition consist mainly of a charge control agent and a colorant, and they predominantly consist of various dyes serving as the charge control agents. The agglomerates are divided into those comprising a charge control agent and a colorant, those solely comprising a charge control agent, and those solely comprising a colorant. According to the first embodiment in which an average sectional area of these agglomerates in a section of toner particles is within a range of from 1.40 to 1.70 $\mu m^2$:, and preferably of from 1.50 to 1.65 $\mu m^2$, and the total sectional area of the agglomerates in the section of toner particles is within a range of from 1.50 to 1.80%, and preferably from 1.55 to 1.75%, the accumulation and release of charge can be well balanced and, at the same time, the formation of agglomerates of the toner and adhesion to a fixing roller can be inhibited.

If the average sectional area of the agglomerates is smaller than 1.40 $\mu m^2$:, the charge quantity tends to increase, this is probably due to the fact that a release of charge on or near the surface of toner particles is suppressed, leading to excessive accumulation of charge. An average sectional area of the agglomerates exceeding 1.70 $\mu m^2$ tends to arise through growth of a charge control agent of large size which also includes a colorant which is not finely dispersed. Such large agglomerates are separated from the composition by a mechanical shock in a developing machine. The thus separated agglomerates contaminate a fixing roller or are interposed among toner particles to cause a variation of charging tendency, resulting in formation of toner particles of opposite polarity and the like.

Besides the above-described average sectional area of individual agglomerates, it is an important requirement that an area ratio of the total agglomerates in a section of toner particles be within a range of from 1.50 to 1.80%. When the area ratio of the agglomerates falls within this range, it is believed that a colorant is present on agglomerates of moderately large size to furnish conducting paths which properly reduce a charge quantity so that a charge quantity may be stably maintained in a saturated state. Even with an average sectional area of individual agglomerates being within the above-specified range, if the total area ratio of the agglomerates is less than 1.5%, the charge quantity tends to increase excessively. When the area ratio increases over 1.5%, the charge quantity of the whole toner shows a tendency to decrease, and an inhibitory effect on the formation of toner particles of opposite polarity is manifested. If the area ratio exceeds 1.8%, the balance between toner particles of opposite polarity tends to be destroyed, resulting in a scatter of toner particles, apparent fog, and white spots.

That is, according to the first embodiment in which dispersed agglomerates have an average sectional area of from 1.4 to 1.7 $\mu m^2$, and preferably from 1.50 to 1.65 $\mu m^2$:, and an area ratio of from 1.5 to 1.8%, and preferably from 1.55 to 1.75%, the variation of charge quantity of the toner can be confined within a proper range, the formation of undesired toner particles of opposite polarity or extremely low charge can be prevented, and formation of toner agglomerates can be suppressed. As a result, a high quality image can be formed in a stable manner during long-term use.

The average sectional area and area ratio of the agglomerates in the section of toner particles can be measured as follows.

A 1.5 mm-square sample of a composition obtained by dispersing and kneading additives such as a colorant and a charge control agent in a binder resin is set in a microtome and cut into slices having a thickness of about 1.0 mm with a glass knife. Three slices which are not continuous with each other are each placed on a slide. 25 views (200 μm×156.3 μm for each view) per slice were converted to a binary image composed of agglomerates (shades) and other parts distinguished under transmitted light by means of an image analyzer ("Quantimet 920 Image Analyzer" manufactured by Cambridge Instruments), and the size of individual agglomerates is measured by means of a computer connected to the image analyzer. An average sectional area of individual agglomerates is obtained by dividing the total size by the number of the agglomerates, and an area ratio of the agglomerates is obtained as an area percentage of the agglomerates (the shades) in the view. The part of parting agents described hereinafter which may be added in the toner composition of the present invention is converted to an image of "other parts (i.e., not shades)".

The second embodiment of the present invention is explained below.

The inventors have found that the developing characteristics of a toner and the phenomena occurring on thermal fixing with a hot roller are not always correlated with the molecular weight distribution or the rheological characteristics (e.g., storage elastic modulus and loss elastic modulus) of a binder resin itself. In fact, they are also influenced by a colorant and a charge control agent as well as a binder resin, and, in addition, the dispersion state of these additives. Hence, these developing characteristics and thermal fixing phenomena rather depend on both the dispersion state of the additives in the toner composition and the rheological characteristics of the whole composition.

The toner according to the second embodiment of the present invention is characterized in that additives such as a colorant are present as agglomerates having an average sectional area of from 1.4 to 1.7 $\mu m^2$ and is also characterized by such rheological characteristics as a dissipation factor (tan δ) which is from 0.95 to 1.25 when a storage elastic modulus (G') is $10^4$ dyne/cm$^2$.

Agglomerates in a toner composition consist mainly of a charge control agent and a colorant, and, predominantly, of various dyes serving as a charge control agent. The agglomerates are divided into those comprising a charge control agent and a colorant, those solely comprising a charge control agent, and those solely comprising a colorant. In the second embodiment of the present invention, when an average sectional area of these agglomerates in a section of toner particles is within a range of from 1.4 to 1.7 $\mu m^2$, and preferably of from 1.50 to 1.65 $\mu m^2$, accumulation and release of charge can be well balanced and, at the same time, formation of defective particles on repetition of an agitation operation can be inhibited. By adjusting rheological characteristics of the composition to the above-recited range with such a dispersion requirement being satisfied, the toner in a fused state exhibits adequate adhesion to a transfer material and nontackiness to a fixing roller. As a result, satisfactory fixing properties can be assured and, at the same time, the fixed toner image has reduced surface unevenness to provide improved image uniformity.

If the average sectional area of the agglomerates is smaller than 1.4 $\mu m^2$, the charge quantity increase because a release of charge on or near the surface of toner particles is suppressed, leading to excessive accumulation of charge. An average sectional area of the agglomerates exceeding 1.7 $\mu m^2$ tends to arise through growth of a charge control agent of large size which also includes colorant which is not finely dispersed. Such large agglomerates are separated from the toner composition by a mechanical shock in a developing machine, and the thus separated agglomerates contaminate a fixing roller or are interposed among toner particles to cause a variation of frictional charging tendency.

On the other hand, if the dissipation factor (tan δ) is lower than 0.95 and the storage elastic modules (G') is $10^4$ dyne/cm$^2$, sufficient adhesion or engagement of the fused toner to a transfer material tends to be lacking thereby causing insufficient fixing. If it is greater than 1.25, part of the fused toner tends to be transferred to a hot roller due to shortage of cohesion, thereby causing offset. In the second embodiment of the invention, in order to obtain high image quality and abrasion resistance of the fixed image it is essential that the toner composition satisfies both of the above-described requirements involving the rheological characteristics and dispersion state. When these conditions are met, delicate waviness or unevenness of the image surface on fixing can be avoided. Thus, image non-uniformity due to density or gloss unevenness and fall-off of a toner from copies due to abrasion can be prevented.

Thus, even with the rheological characteristics of the toner falling within the above range, if the average sectional area of the agglomerates exceeds the specified upper limit, there is produced a local difference in properties between a fixing roller and a fused toner, which tends to cause waviness or unevenness on the fixed image surface, even though offset may be prevented.

In the second embodiment of the invention, it is preferable that the total area ratio of the agglomerates in a section of toner particles ranges from 1.5 to 1.8%. When the area ratio of the agglomerates falls within this range, it is believed that a colorant is present as agglomerates of moderately large size to furnish conducting paths which properly reduce a charge quantity so that a charge quantity may be stably maintained in a saturated state. If the area ratio of the agglomerates is less than 1.5%, the charge quantity tends to increase excessively. When the area ratio increases over 1.8%, the charge quantity of the whole toner tends to decrease, thus forming particles of opposite polarity, which results in a scatter of toner particles and image fog.

The average sectional area and area ratio of agglomerates in a section of toner particles in the second embodiment can be determined in the same manner as in the first embodiment.

The dissipation factor (tan δ) of the composition is the ratio of loss elastic modulus (G") to storage elastic modulus (G'). These rheological values can be obtained as follows. A toner is molded by a hot press into a sheet specimen of 20 mm×20 mm×2 mm (t). Sine wave vibration (measured frequency: 1 Hz) is applied to the specimen kept at a prescribed temperature. Thus, vibration is applied in a shear direction in a forced vibration non-resonance system. It is accomplished by means of Dinamic Visco-Elastic Analyzer manufactured by Rheology K. K. Thus, a stress response under an ultramicro displacement is measured. A storage elastic modulus (G'), a loss elastic modulus (G"), and a dissipation factor (tan δ) are obtained from the dynamic force and the dynamic deformation according to a known calculation method.

The rheological characteristics of the toner composition according to the present invention are specified not by individual values of storage elasticity modulus (G') and loss elastic modulus (G") but by a ratio G"/G', i.e., a dissipation factor (tan δ), because a storage elasticity modulus (G') is concerned with cohesive force of the composition while a loss elasticity modulus (G") is concerned with viscosity of the composition. Therefore, the toner's fixing properties and offset properties on contact with a heat fixing roller are related to a balance of these two factors. The reason for specifying the dissipation factor (tan δ) as a value which is determined when the storage elasticity modulus (G') is $10^4$ dyne/cm$^2$ ($10^3$ Pa) is because the present invention aims at the prevention of offset or unevenness of the fixed image surface even under severe conditions, i.e., at such a low storage elasticity modulus as $10^4$ dyne/cm$^2$. It has been considered that when a cohesive force is so small then offset and surface waviness of a fixed image are likely to occur.

The above-described toner of the present invention can be prepared, though its contents may vary depending on the kind of binder resin, charge control agent, or colorant, etc. employed. It is also possible to vary the toner by adjusting the time of premixing of raw materials by use of a Henschel mixer, etc. before kneading, by altering the energy at the time of kneading, e.g., the number of axial revolutions, the amount of the materials to be charged, the kneading rate, and the heating temperature.

If a premixing time is extended, each raw material (e.g., a binder resin, a charge control agent, and a colorant) is finely pulverized. When such finely pulverized materials are kneaded, they are finely divided in the resulting dispersion, and the average sectional area of agglomerates in the section of the composition tends to be reduced. If the premixing time is shortened, the charge control agent and the colorant are agglomerated in the binder resin. When such a premixture containing agglomerates is kneaded, many agglomerates remain in the resulting dispersion, tending to result in an increased average sectional area of the agglomerates in the section of the composition. For example, when using a styrene copolymer as a binder resin, a metal complex dye as a charge control agent, and carbon black as a colorant, the premixing is suitably carried out so that the premixture may have a degree of compaction ranging from 30 to 50%. The terminology "degree of compaction" as used herein means a value obtained by a formula:

Degree of Compaction (%)=(Apparent density in tight packing−Apparent density in loose packing)/Apparent density in tight packing×100.

"Apparent density in loose packing" is obtained by passing a powder mixture of a binder resin, a colorant, a charge control agent, etc. through a 24 mesh sieve, letting the powder fall in a 100 cc cell, and measuring the weight of 100 cc of the powder in the cell.

"Apparent density in tight packing" is obtained by fixing an extension cell (2) to the cell (1) containing the powder after measurement of an apparent density in loose packing as illustrated in FIG. 1, tapping the cell (1) at a rate of 1 sec/time for 180 seconds to compact the powder, and measuring the volume of the thus compacted powder (3). The degree of compaction can be measured with, for example, Powder Tester manufactured by Hosokawa Micron Corporation.

Adjustment of kneading energy acts as a factor which particularly decides an area ratio of agglomerates in the section of the composition. That is, as a kneading rate is increased, the area ratio of agglomerates tends to increase. As the number of revolutions is increased or the kneading temperature is elevated, the area ratio of agglomerates tends to decrease, and/or the melt viscosity of the composition tends to increase. In general, the kneading rate is appropriately selected in the range of from 40 to 120 kg/hr, and the kneading temperature is appropriately selected in the range of from 130° to 180° C.

The above-mentioned premixing is conducted by use of the any of the known mixing apparatuses, such as a dry blender, a Henschel mixer, and a ball mill. Melt-kneading is performed by use of any of the known kneading apparatuses, such as a Banbury mixer, a roll, and a single-screw or twin-screw extruder.

Examples of binder resins which can be used in the present invention include styrene resins, e.g., polystyrene, polychlorostyrene, poly-α-methylstyrene, styrene-chlorostyrene copolymers, styrene-butadiene copolymers, styrene-vinyl chloride copolymers, styrene-maleic ester copolymers, styreneacrylic ester copolymers, and styrene-methacrylic ester copolymers; vinyl chloride resins, styrene-vinyl acetate copolymers, rosin-modified maleic acid resins, phenyl resins, epoxy resins, polyester resins, low-molecular weight polypropylene, ionomer resins, polyurethane, silicone resins, ketone resins, ethylene-ethyl acrylate copolymers, xylene resins, and polyvinyl butyral resins.

Figure 2:
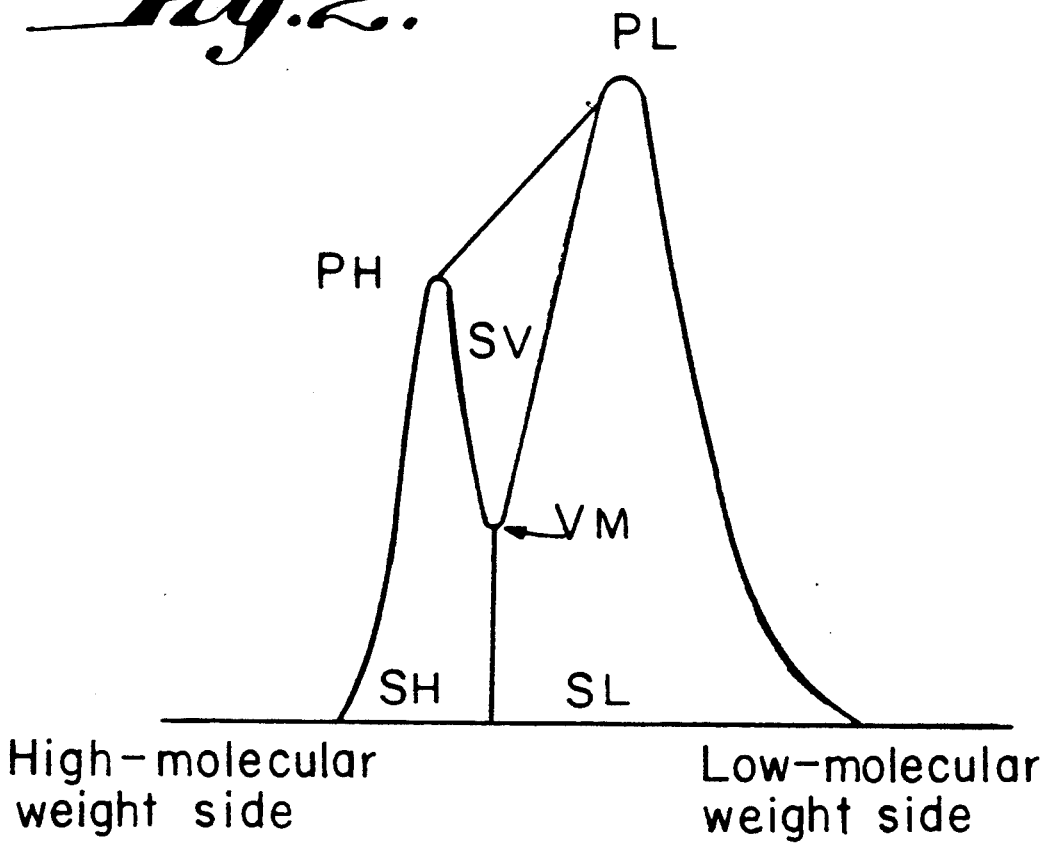
FIG. 2 is a gel-permeation chromatogram for explanation of preferred binder resins.

Preferred of those listed above are styrene-acrylate copolymers and polyester resins because of their excellent processability. To use a styrene-acrylate copolymer, it preferably has a gel-permeation chromatogram, as shown in FIG. 2, in which a peak in the high-molecular side $P_H$ is at a molecular weight higher than $1\times10^5$, a peak in the low-molecular side $P_L$ is at a molecular weight between 500 and $2\times10^4$, and a ratio of the area $S_V$ of the valley surrounded by lines $P_{H-VM}$ and $P_{L-VM}$ ($V_M$ is the minimum between $P_H$ and $P_L$) and the straight line l connecting $P_H$ and $P_L$ to the sum of a high molecular side peak area $S_H$ (the area on the side of higher molecular weight than $V_M$) and a low-molecular side peak area $S_L$ (the area on the side of lower molecular weight than $V_M$), i.e., a V/P ratio$=S_V/(S_H+S_L)$, is not more than 0.3, and particularly not more than 0.2. Such a molecular weight distribution means that a relatively low-molecular weight portion of the high-molecular component and a relatively high molecular weight portion of the low-molecular component, i.e., middle-molecular weight components, form a large proportion. The above-mentioned molecular weight. distribution has the tendency to adjust rheology of the composition to the above-described range.

When a polyester resin is used as a binder resin, those which are obtained by polycondensation of a diol component and a polycarboxylic acid or an anhydride or a derivative thereof and which have a softening point of from 105° to 160° C. (measured by flow tester) and a glass transition temperature of from 50° to 80° C. are preferably used.

Examples of suitable colorants which can be used in the present invention include carbon black, lamp black, chrome yellow, Hansa Yellow, Benzidine Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengale, Aniline Blue, Ultramarine Blue, Methylene Blue Chloride, Phthalocyanine Blue, Phthalocyanine Green, Malachite Green Oxalate, zinc white, titanium oxide, valentinite, C.I. Solvent Yellow 60, C.I. Solvent Red 27, and C.I. Solvent Blue 35. These colorants are used either individually or in combination of two or more thereof. The colorant is usually used in an amount of from 1 to 30 parts by weight per 100 parts by weight of a binder resin.

Charge control agents which can be used in the present invention include known charge control agents such as oil soluble dyes, e.g., Nigrosine dyes, Oil Black, and Spiron Black, fatty acid metallic soaps, metallized monoazo dyes, metal salts or complex salts of salicylic acid and/or an alkylsalicylic acid, and metal salts or complex salts of naphthoic acid. Preferred of them are metal complex dyes, and more preferred are 1:2 type metallized monoazo dyes. The charge control agent is used in an amount of generally from 0.5 to 10 parts by weight per 100 parts by weight of a binder resin.

In addition to the above-described colorants and charge control agents, the toner composition may further contain a parting agent, such as low-molecular polypropylene, various waxes and silicone oil, to endow the toner with an anti-offset effect.

Toner particles generally have an average particle size of from 5 to 20 μm, and preferably from 7 to 15 μm, as measured with a Coulter counter.

To improve fluidity, the toner particles are preferably treated with a known surface treating agent such as inorganic fine particles, e.g., hydrophobic silica fine particles, and resin fine particles, e.g., acrylic polymer particles, silicone resin particles, and fluorine resin particles. The amount of the surface treating agent is generally from 0.1 to 5 parts by weight per 100 parts by weight of the toner particles. When it is less than 0.1 part, the effect does not appear. When it is more than 5 parts, the charge of the toner becomes too high.

According to the present invention, since agglomerates mainly comprising a colorant and a charge control agent are dispersed in a binder resin to satisfy specific dispersion conditions, the formation of defective toner particles of extremely low charge or of opposite polarity can be suppressed, and the scattering of toner particles and background fog which have frequently occurred with conventional toners can be inhibited to a great extent. Further, agglomeration of toner particles can be prevented during long-term use so that image formation with high density and high quality images can be obtained without undergoing apparent fog or white spots.

The present invention is now illustrated in greater detail with reference to Examples, but it should be understood that the present invention is not deemed to be limited thereto. All the parts, percents and ratios are by weight unless otherwise indicated.

| | |
|---|---|
| Styrene-acrylate copolymer (styrene/acrylate = 80/20; average molecular weight = 147,000 by weight) (binder resin) | 100 parts |
| Carbon black | 9 parts |
| Chromium complex azo dye (charge control agent) | 2 parts |
| Low-molecular polypropylene* | 1 part |

*average molecular weight by weight 4000

The above components were premixed in a Henschel mixer and then melt-kneaded in a twin-screw extruder under varied premixing or kneading conditions as shown in Table 1 below to prepare a resin composition having a varied dispersion state. The resin composition was ground and classified to obtain a toner having an average particle size of 11 μm. The resulting toner was designated toner (a), (b) or (c).

| | |
|---|---|
| Styrene-acrylate copolymer (styrene/acrylate = 80/20; average molecular weight = 147,000 by weight) | 100 parts |
| Carbon black | 8 parts |
| Aluminum complex azo dye | 1.5 part |
| Low-molecular polypropylene* | 1 part |

Toners (d), (e), and (f) were prepared from the above components in the same manner as in Example 1.

| | |
|---|---|
| Polyester resin | 100 parts |
| Carbon black | 7.5 parts |
| Cobalt complex azo dye | 2 parts |
| Low-molecular polypropylene* | 1.0 part |

Toners (g), (h), or (i) were prepared from the above components in the same manner as in Example 1.

An average sectional area of agglomerates and an area ratio of agglomerates in a section of each of toners (a) to (i) were measured by the previously described method. The results obtained are shown in Table 1.

Each toner was mixed with 0.3 parts of silica fine particles (surface treating agent) per 100 parts of the toner. Durability of the resulting toner in making 20,000 copies by a copying machine DC-3255 (copying speed: 32 copies of A4 size per minute), manufactured by Mita Industrial Co., Ltd., was evaluated according to the following test methods. The results of evaluations are shown in Table 1.

1) Image Density Maintenance

Image density was measured on 21 out of 20,000 copies sampled for every 1000 copies with Reflectometer Model TC-6D (a reflective densitometer) manufactured by Tokyo Denshoku K. K.. Image density maintenance was rated according to the following standards:

Good: 20 or more copies had a density of 1.3 or more.
Medium: 15 to 19 copies had a density of 1.3 or more.
Poor: 14 or less copies had a density of 1.3 or more.

2) Image Fog

Image fog was measured on 21 out of 20,000 copies sampled for every 1000 copies in the same manner as in above and rated according to the following standards:

Good: 20 or more copies had a fog of 0.003 or less.
Medium: 15 to 19 copies had a fog of 0.003 or less.
Poor: 14 or less copies had a fog of 0.003 or less.

3) Apparent Fog

Fog on the white background of the toner image before fixing was measured by means of an image analyzer, Quantimet 920 Image Analyzer manufactured by Cambridge Instruments Corp., to prepare a histogram of size distribution of the adhered toner particles. A proportion (%) of the number of particles of 20 μm or greater in all the adhered particles was obtained. "Apparent fog" is a state perceived as by the with eye although the above-described image fog is low. An apparent fog of more than 7% was judged defective.

4) White Spots in Image Area

White spots on 21 out of 20,000 copies sampled for every 1000 copies were observed and rated as follows.

Good: 20 or more copies were free from white spots.

Medium: 15 to 19 copies were free from white spots.

Poor: 14 or less copies were free from white spots.

5) Contamination of Roller

Stains due to contamination of a fixing roller were observed on 21 out of 20,000 copies sampled for every 1000 copies and rated as follows.

Good: 20 or more copies were free from stains.

Medium: 15 to 19 copies were free from stains.

Poor: 14 or less copies were free from stains.

TABLE 1

| Toner No. | Degree of Compaction (%) | Kneading Temp. (°C.) | Kneading Rate (kg/hr) | Average Sectional Area ($\mu m^2$) | Area Ratio (%) | Image Density | Image Fog | Apparent Fog (%) | White Spots | Contamination of Roller |
|---|---|---|---|---|---|---|---|---|---|---|
| a | 36 | 150 | 65 | 1.55 | 1.65 | Good | Good | 3 | Good | Good |
| b | 45 | 155 | 65 | 1.45 | 1.63 | Good | Good | 4 | Good | Good |
| c | 28 | 155 | 65 | 1.80 | 1.55 | Good | poor | 4 | Good | Poor |
| d | 55 | 150 | 70 | 1.35 | 1.73 | Poor | Good | 7 | Good | Good |
| e | 43 | 145 | 80 | 1.42 | 1.85 | Good | Medium | 14 | Poor | Good |
| f | 40 | 145 | 65 | 1.45 | 1.70 | Good | Good | 4 | Good | Good |
| g | 32 | 160 | 70 | 1.68 | 1.56 | Good | Good | 4 | Good | Medium |
| h | 42 | 165 | 65 | 1.52 | 1.43 | Poor | Good | 3 | Good | Good |
| i | 25 | 160 | 65 | 1.72 | 1.47 | Poor | Poor | 3 | Medium | Poor |

It can be seen from the results in Table 1 that the toners according to the present invention in which the average sectional area and area ratio of agglomerates fall within the respective specific ranges achieve satisfactory results in all the items of performance evaluation, proving capable of continuously providing high quality copies.

EXAMPLE 4

| | |
|---|---|
| Styrene-methyl methacrylate-butyl acrylate copolymer (80:5:15) ($P_H$: 335000; $P_L$: 13900; V/P: 0.21) | 100 parts |
| Carbon black | 8 parts |
| Chromium complex azo dye | 2.5 parts |
| Low-molecular polypropylene* | 1.5 parts |

Toners (j), (k), and (l) were prepared from the above components in the same manner as in Example 1.

EXAMPLE 5

| | |
|---|---|
| Styrene-methyl methacrylate-butyl acrylate copolymer (75:5:20) ($P_H$: 450000; $P_L$: 12500; V/P: 0.188) | 100 parts |
| Carbon black | 8 parts |
| Aluminum complex azo dye | 1.5 parts |
| Low-molecular polypropylene* | 1 part |

Toners (m), (n), and (o) were prepared from the above components in the same manner as in Example 1, except that the toner particles had an average particle size of 10 μm.

EXAMPLE 6

| | |
|---|---|
| Polyester resin (softening point: 122° C.; glass transition temp.: 62° C.) | 100 parts |
| Carbon black | 7 parts |
| Cobalt complex azo dye | 1 part |
| Low-molecular polypropylene* | 1.0 part |

Toners (p), (q), and (r) were prepared from the above components in the same manner as in Example 1, except that the toner particles had an average size of 8 μm.

An average sectional area and an area ratio of agglomerates and a storage elasticity modulus (G') and a dissipation factor (tan δ) of each of toners (j) to (r) were measured by the previously described methods. The results obtained are shown in Table 2.

Performance properties of the resulting toner were evaluated as follows. The results of evaluations are also shown in Table 2.

1) Fixing Properties:

The toner was mixed with a ferrite carrier to prepare a developer having a toner concentration of 4%. The developer was charged in an electrophotographic copying machine, a modified model of DC-3285 manufactured by Mita Industrial Co., Ltd., and copies of a black solid original were taken while raising a set temperature of a fixing roller from 130° C. by 2.5° C. Adhesive tape was adhered on the fixed toner image and then stripped off. The fixed image density was measured with Reflectometer Model manufactured by Tokyo Denshoku K. K. either before or after stripping of the adhesive tape to obtain a fixing rate (%) according to equation:

$$\text{Fixing Rate (\%)} = \frac{\text{Image density after stripping}}{\text{Image density before stripping}} \times 100$$

The lowest temperature at which the fixing rate exceeds 90% was taken as a lowest fixing temperature ($F_1$). Then, the elevated temperature at which offset took place was taken as an offset inducing high temperature ($F_2$). The difference between $F_1$ and $F_2$ was taken as a fixing temperature range (FΔ). Toners having a fixing temperature range (FΔ) of 50° C. or wider were judged acceptable.

2) Copying Durability:

The toner was mixed with 0.1% of hydrophobic silica and then with a ferrite carrier to prepare a developer having a toner concentration of 4%. The developer was charged in an electrophotographic copying machine DC-5585 manufactured by Mita Industrial Co., Ltd. (55 copies of A4 size per minute), and 20,000 copies were taken.

Image density and fog density were measured on 21 out of 20,000 copies sampled for every 1000 copies with Reflectometer Model TC-6D manufactured by Tokyo Denshoku K. K.. and rated according to the following standards:

Image Density Maintenance:

Good: 20 or more copies had a density of 1.3 or more.
Medium: 15 to 19 copies had a density of 1.3 or more.
Poor: 14 or less copies had a density of 1.3 or more.

Image Fog:

Good: 20 or more copies had a fog of 0.003 or less.
Medium: 15 to 19 copies had a fog of 0.003 or less.
Poor: 14 or less copies had a fog of 0.003 or less.

3) Uniformity of Fixed Image Surface 20,000 copies were taken in the same manner as in 2 above. Each of 21 out of 20,000 copies sampled for every 1000 copies was placed on a rubber-made mount, and the surface of the fixed image was rubbed with 5 strokes of a cylindrical weight of soft steel having a height of 26 mm and a diameter of 50 mm (20 g/cm$^2$) with its bottom covered with cotton cloth. Uniformity of the fixed image surface was evaluated from a fixing rate (%) obtained from equation:

$$\text{Fixing Rate (\%)} = \frac{\text{Image density after rubbing}}{\text{Image density before rubbing}} \times 100$$

and rated according to the following standards.

Good: 20 or more copies had a fixing rate of more than 95%.
Medium: 15 to 19 copies had a fixing rate of more than 95%.
Poor: 14 or less copies had a fixing rate of more than 95%.

4) Impact Resistance

A rate of formation of a spent toner (S value %) was obtained from a difference between the carbon content (CI) in the carrier after release of the toner of the developer to be used for copying and the carbon content (CE) in the carrier after release of the toner of the developer having been used for 20,000 continuous runs (S value CE−CI). The carbon contents (%) were measured by means of Carbon Analyzer (EMIA-110, manufactured by Horiba K. K.).

TABLE 2

| Toner No. | Average Sectional Area (μm$^2$) | tan δ* | Area Ratio (%) | Degree of Compaction (%) | Kneading Temp. (°C.) | Kneading Rate (kg/hr) | Image Density | Fog | $F_1$ (°C.) | $F_2$ (°C.) | FΔ (°C.) | Surface Uniformity | S Value (%) |
|---|---|---|---|---|---|---|---|---|---|---|---|---|---|
| j | 1.44 | 0.92 | 1.85 | 48 | 145 | 80 | Good | Medium | 155 | 195 | 40 | Medium | 0.12 |
| k | 1.76 | 1.05 | 1.67 | 29 | 153 | 70 | Medium | Medium | 140 | 195 | 55 | Poor | 0.55 |
| l | 1.51 | 1.17 | 1.71 | 42 | 155 | 65 | Good | Good | 140 | 195 | 55 | Good | 0.12 |
| m | 1.23 | 1.33 | 1.87 | 61 | 180 | 85 | Poor | Poor | 150 | 180 | 30 | Poor | 0.18 |
| n | 1.47 | 1.27 | 1.72 | 41 | 165 | 60 | Medium | Medium | 145 | 185 | 40 | Medium | 0.16 |
| o | 1.53 | 1.19 | 1.66 | 39 | 160 | 65 | Good | Good | 145 | 200 | 55 | Good | 0.11 |
| p | 1.43 | 1.16 | 1.71 | 42 | 158 | 60 | Medium | Good | 140 | 195 | 55 | Good | 0.13 |
| q | 1.46 | 1.17 | 1.68 | 44 | 155 | 65 | Good | Good | 145 | 195 | 50 | Good | 0.13 |
| r | 1.71 | 0.98 | 1.82 | 23 | 125 | 110 | Poor | Poor | 155 | 185 | 30 | Poor | 0.61 |

Note:
*Storage elastic modulus = $10^4$ dyne/cm$^2$

As is apparent from Table 2, the toners (l), (o), (p), and (q) according to the present invention having a tan δ within the range of from 0.95 to 1.25 and an average sectional area of agglomerates within the range of from 1.4 to 1.7 μm$^2$ achieved excellent results in all the items of performance evaluation. The fixed toner image obtained from these toners had a uniform surface and thereby clear image quality.

Toner (k) showed medium results with respect to image density and fog and had a fixing temperature range 50° C. or more. However, it was considerably poor in uniformity of a fixed image surface and proved unsatisfactory from the standpoint of image quality and fall-off of toner from copies.

According to the present invention, there is provided a toner excellent in developing properties, fixing properties, and anti-offset properties and capable of forming a fixed image free from unevenness on its surface to provide a clear image excellent in image quality uniformity. Further, fall-off of a toner from the copies can be reduced to prevent contamination of other objects such as hands, clothing and other sheeting.

While the invention has been described in detail and with reference to specific examples thereof, it will be apparent to one skilled in the art that various changes and modifications can be made therein without departing from the spirit and scope thereof.

What is claimed is:

1. A toner composition comprising a binder resin, colorants and charge control agents, wherein said colorants and charge control agents are dispersed as toner particles in said binder resin; and wherein said colorants and charge control agents are present in said binder resin as agglomerates having an average sectional area of from 1.4 to 1.7 μm$^2$ in a section of toner particles, the total sectional area of the agglomerates in the section of toner particles ranging from 1.5 to 1.8%.

2. A toner composition according to claim 1 wherein said binder resin is a material selected from the group consisting of polystyrene, polychlorostyrene, poly-α-methylstyrene, styrene-chlorostyrene copolymers, styrene-butadiene copolymers, styrene-vinyl chloride copolymers, styrene-maleic ester copolymers, styrene-acrylic ester copolymers, and styrene-methacrylic ester copolymers, vinyl chloride resins, styrene-vinyl acetate copolymers, rosin-modified maleic acid resins, phenyl resins, epoxy resins, polyester resins, low-molecular weight polypropylene, ionomer resins, polyurethane, silicone resins, ketone resins, ethylene-ethyl acrylate copolymers, xylene resins, and polyvinyl butyral resins.

3. A toner composition according to claim 1, wherein said binder resin is styrene-acrylate copolymers or polyester resins.

4. A toner according to claim 1, wherein said colorant is a material selected from the group consisting of carbon black, lamp black, chrome yellow, Hansa Yellow, Benzidine Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengale, Aniline Blue, Ultramarine Blue, Methylene Blue Chloride, Phthalocyanine Blue, Phthalocyanine Green, Malachite Green Oxalate, zinc white, titanium oxide, valentinite, C.I. Solvent Yellow 60, C.I. Solvent Red 27, and C.I. Solvent Blue 35.

5. A toner according to claim 1 wherein said charge control agent is selected from a group consisting of Nigrosine dyes, Oil Black, Spiron Black, fatty acid metallic soaps, metallized monoazo dyes, metal salts of salicylic acid, complex salts of salicylic acid, metal salts of alkylsalicylic acid, complex salts of alkylsalicylic acid, metal salts of naphthoic acid, and complex salts of naphthoic acid.

6. A toner composition according to claim 1, wherein said charge control agent is a metallized monoazo dye.

7. A toner composition according to claim 1 further comprising a parting agent, wherein said parting agent is selected from the group consisting of low-molecular polypropylene, waxes, and silicone oil.

8. A toner composition according to claim 1, wherein the toner composition is in the form of particles having an average particle size of from 5 to 20 μm.

* * * * *